United States Patent [19]

Sundqvist

[11] 4,166,499

[45] Sep. 4, 1979

[54] METHOD AND AN APPARATUS FOR PREVENTING DEPOSITS IN A PROCESS WATER SYSTEM FOR A GAS GENERATOR PLANT OR THE LIKE

[75] Inventor: Hans E. Sundqvist, Motala, Sweden

[73] Assignee: AB Motala Verkstad, Motala, Sweden

[21] Appl. No.: 839,656

[22] Filed: Oct. 5, 1977

[51] Int. Cl.[2] ..... B03C 3/00

[52] U.S. Cl. ..... 165/134 R; 55/11

[58] Field of Search ..... 165/134, 107 D, 110; 55/267, 229, 11; 210/55

[56] References Cited

U.S. PATENT DOCUMENTS 3,426,837 2/1969 Moore ..... 165/107 D X 3,989,102 11/1976 Jaster ..... 165/107 D X

*Primary Examiner*—Alan Cohan

*Attorney, Agent, or Firm*—Dressler, Goldsmith, Clement, Gordon & Shore, Ltd.

[57] ABSTRACT

A gas generator plant with a gas generator and a process water system for cooling or scrubbing liquid comprises at least one heat exchanger for transferring heat to the process water. The plant has a pressure controlling means in the conduits for the process water connected to the heat exchanger. This pressure controlling means may consist of a pressure increasing means in the supply conduit for the process water or a pressure decreasing means in the return conduit for the process water.

5 Claims, 8 Drawing Figures

METHOD AND AN APPARATUS FOR PREVENTING DEPOSITS IN A PROCESS WATER SYSTEM FOR A GAS GENERATOR PLANT OR THE LIKE

The present invention is applicable to gas generator plants in which waste, such as garbage, bark and sewage sedimentation sludge, for example, is gasified and burned and the potential heat content of the waste is utilized in an economically favorable manner whilst, at the same time, hydrocarbons such as phenols dissolved in water separated from the waste are prevented from being discharged to the surroundings and from creating environmental problems in the form of contaminants in sewage water. Therefore, it has been suggested that the water soluble organic compounds should be refluxed to the gas generator together with water condensed on cooling. However, on the formation of vapor, when heating in a heat exchanger, the particles dissolved in the process water are precipitated and deposited on the walls, etc., of the conducting system to cause, for example, choking up and insulation of walls in the system.

The object of the present invention is to prevent deposits in a process water system for a gas generator plant of that kind, where the process water has a temperature and a pressure which enables vapor formation and thereby boiling with resulting deposits of solid material in the system.

This problem is solved in that the gas generator plant, which has a process water system comprising at least one heat exchanger, is provided with at least one pressure controlling means in the conduits for the process water connected to the heat exchanger.

So that the invention may be more readily understood and further features thereof made apparent, the invention will now be described with reference to the accompanying drawings, in which.

Figure 1:
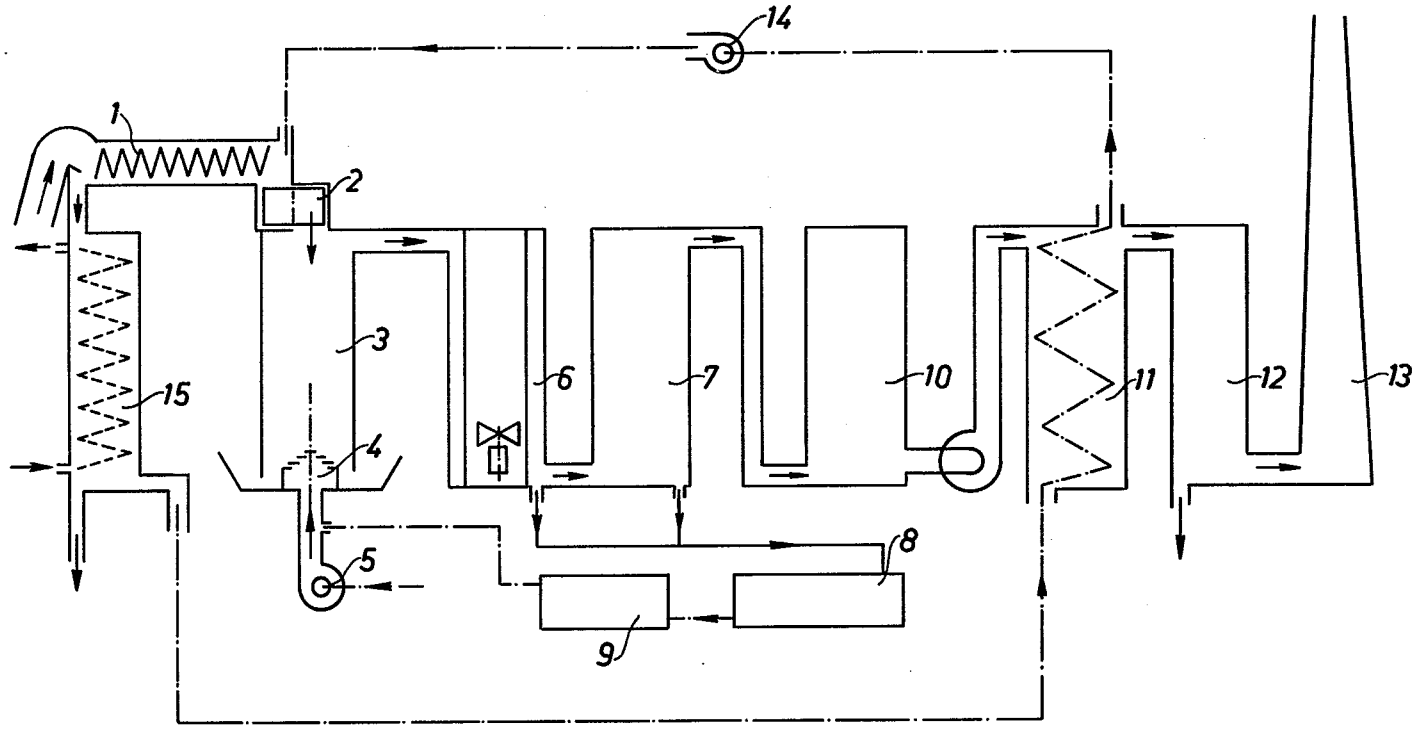
FIG. 1 shows diagrammatically a first plant for gasifying and combusting waste.
Figure 2:
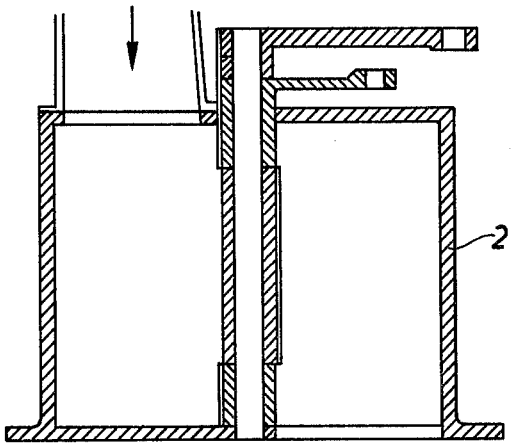
FIG. 2 shows a rotary vane feeder for charging waste to a gas generator in that plant.
Figure 4:
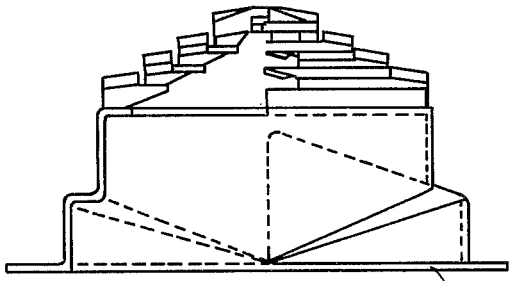
FIG. 4 illustrates a diagrammatical section of the rotary grate.
Figure 3:
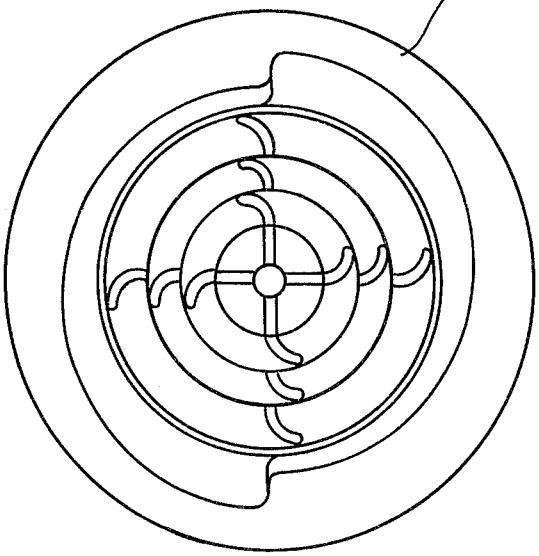
FIG. 3 shows a rotary grate in the gas generator.

With the illustrated embodiment of FIG. 1, the waste is fed to a drying apparatus 1 in which the moisture content of the waste is reduced, whereafter the waste is fed by means of a rotary vane feeder 2 to a gas generator 3, in which the waste is gasified. The rotary vane feeder 2 is constructed in a manner such that only the amount of gas capable of leaking through the seals is able to pass back to the drying apparatus 1. The gas generator 3 is provided with a rotatable Huth-grate 4, which is so strongly constructed that the waste can be broken down by impact without damage to the grate, despite the possible occurrence of metal in the scrap. The air required to generate a gas is introduced to the gas generator through a fan 5.

In order to obtain as uniform a gas quality as possible, despite the fact that the moisture content of the waste may vary greatly, and in order to separate water containing water-soluble hydrocarbons, the generated gas is passed through a gas cooler 6 and an electric filter 7, where tar and water are separated. The separated products are passed to a sedimentation tank 8, from which water containing water-soluble carbons is passed to a steam generator 9, in which the water containing the dissolved hydrocarbons is vaporized, whereafter the water vapor is passed back to the gas generator 3.

Subsequent to having passed through the gas cooler 6 and the electric filter 7, the gas generated in the gas generator 3 is passed into a steam generator 10, where the gas is combusted and steam for heating purposes or for generating power is produced. The gases obtained in the steam generator 10 are passes through a heat exchanger 11 and an electric filter 12 before being released to atmosphere through a chimney 13.

Air is heated in the heat exchanger 11 for drying the waste in the drying apparatus 1. Subsequent to having passed through the drying apparatus, the air is passed through a condensor 15 where water absorbed by the air is condensed and removed. The pressure required to circulate the drying air is obtained from a fan 14 incorporated in the air conduit system.

Figure 5:
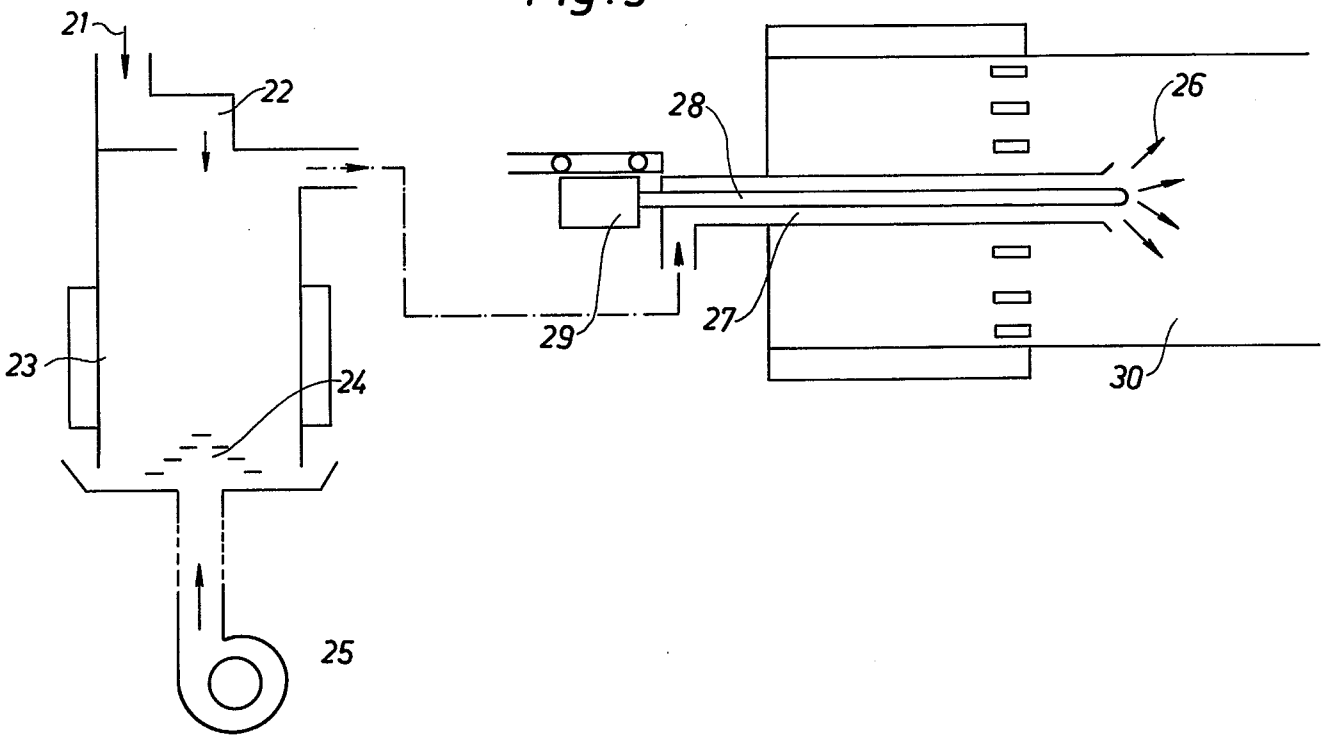
FIG. 5 illustrates diagrammatically a further plant for gasifying and combusting waste.

With the plant illustrated in FIG. 5, waste is introduced through an inlet 21, to a rotary vane feeder 22. If desired, the inlet 21 may be provided with a known drying apparatus (now shown) in which the moisture content of the waste is reduced. The rotary vane feeder introduces the waste into a gas generator 23, in which the waste is gasified. The gas generator 23 is constructed in a manner such that only the amount of gas able to leak through the seals can pass back to the inlet 21. The gas generator 23 is provided with a rotatable grate 24, which is so robustly dimensioned that the waste can be satisfactorily broken up by impact, despite the possible occurrence of heavy impact forces due to metal embodied in the scrap. The air required by the gas generator for combusting waste charge thereto is introduced to the generator by a fan 25.

The gas generated in the gas generator is passed therefrom to one or more burners 27 arranged in a combustion chamber 30, the burners suitably having the form of pipes extending around a known burner 28 constructed for such fuel as fuel oil or powdered coal, for example, which with the illustrated embodiment are fed from a diagrammatically illustrated unit 29 of known type. By gasifying the waste in a gas generator prior to the combustion step, a small air surplus is required in the combustion chamber to burn said fuel. When combusting, for example, fuel oil which is injected into the combustion chamber directly through burners, or powdered coal which is blown into the combustion chamber through burners, a large air surplus is required.

Figure 6:
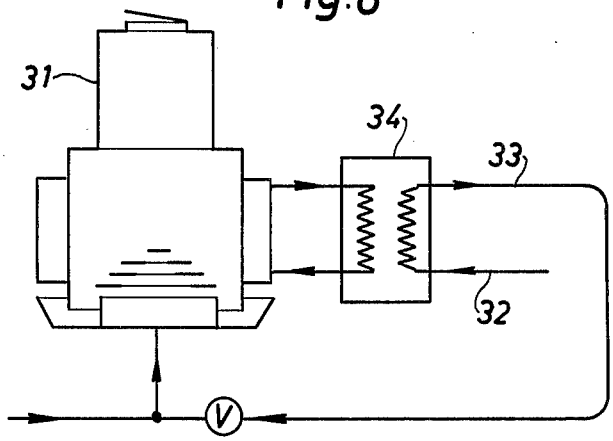
FIG. 6 shows diagrammatically a process water system in the above mentioned plants without apparatus for preventing deposits.

In FIG. 6, a process water system is shown. Process water, which can be condensate from the cooling of gas generated in the gas generator 3 (FIG. 1), 23 (FIG. 5), or 31 (FIG. 6), or scrubbing liquid from cleaning the gas, is introduced into the gas generator via the conduits 32 and 33. FIG. 6 shows direct passage of the process water via the conduits 32 and 33 through the heat exchanger 34, whereby deposits can occur in the heat exchanger.

Figure 7:
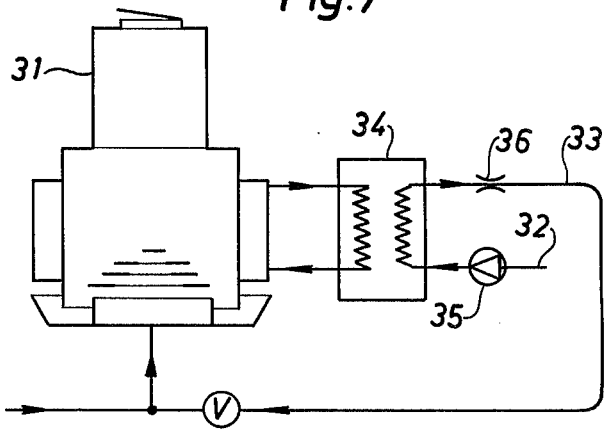
FIGS. 7 and 8 show diagrammatically process water systems with apparatus for preventing deposits.

FIG. 7 shows a device according to the invention with a pressure increasing means 35 in the supply conduit 32 and a pressure reducing means 36 in the return conduit 33 from the heat exchanger 34. One of these means can be excluded if the pressure conditions in the process water so permit.

Figure 8:
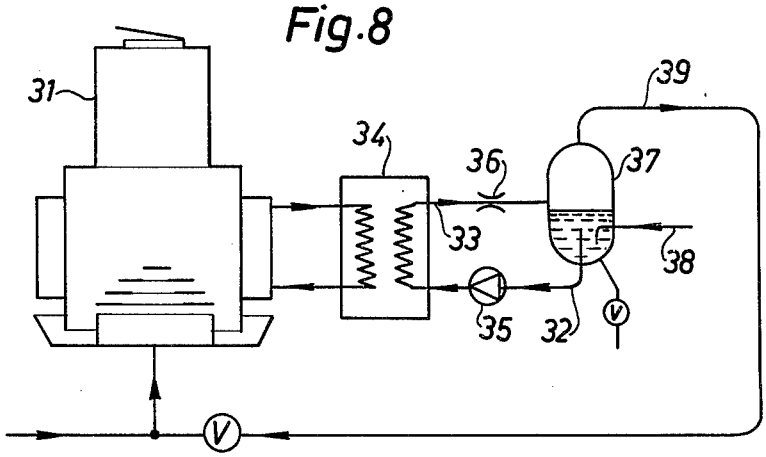

FIG. 8 shows how the process water passes a container 37 via the conduits 38 and 39, the supply of process water in said container being heated by a flow circulating via the conduit 32, the pressure increasing means 35, the heat exchanger 34, the conduit 33 and the pressure decreasing means 36 and back to the container 37. The amount of process water circulating through the heat exchanger 34 is to advantage several times as great as the amount passing the conduits 38 and 39, and preferably three times as great. Temperature and pressure conditions in the heat exchanger can to advantage be selected so that a partial vaporization of the process water takes place when passing the pressure decreasing means 36.

The invention is not limited to the embodiment shown but can be varied within the purview of the invention as defined in the claims.

What is claimed is:

1. An improved gas generator plant having a gas generator, means for cleaning the gas produced in the generator, said means separating water and water soluble organic compounds from the gas during said cleaning, means for evaporating at least a portion of said water to form water vapor carrying at least a portion of said water soluble organic compounds, and means for supplying the water vapor and the water soluble organic compounds carried thereby to the gas generator, said evaporation means including a heat exchanger for heating said water to a temperature which at a predetermined pressure enables vapor formation and thereby boiling, conduit means for supplying the water and the water soluble organic compounds to and from the heat exchanger, and at least one pressure controlling means in said conduit means for preventing boiling of the water and thereby precipitation of the water soluble organic compounds in the heat exchanger.

2. A plant according to claim 1 in which the pressure controlling means consists of a pressure increasing means in the conduit means leading to the heat exchanger.

3. A plant according to claim 1 in which the pressure controlling means consists of a pressure decreasing means in the conduit means exiting from the heat exchanger.

4. A plant according to claim 1 characterized by two pressure controlling means, the first of which consists of a pressure increasing means in the conduit means leading to the heat exchanger and a pressure decreasing means in the conduit means exiting from the heat exchanger.

5. A plant according to claim 4 including a collecting container for said water disposed before the pressure increasing means and after the pressure decreasing means and said collecting container has an inlet for said water and an outlet for the water vapor and the water soluble organic compounds to the gas generator.

* * * * *